United States Patent [19]

Tschentscher

[11] 4,136,834

[45] Jan. 30, 1979

[54] METHOD AND DEVICE FOR INSERTING THREADS, YARNS AND THE LIKE INTO A WINDING DEVICE

[75] Inventor: Alfred Tschentscher, Cologne, Fed. Rep. of Germany

[73] Assignee: FMN Schuster & Company, Hurth Efferen, Fed. Rep. of Germany

[21] Appl. No.: 808,089

[22] Filed: Jun. 20, 1977

[30] Foreign Application Priority Data

Jun. 19, 1976 [DE] Fed. Rep. of Germany ..... 2627643

[51] Int. Cl.[2] ..... B65H 54/02; B65H 54/20

[52] U.S. Cl. ..... 242/18 PW; 242/35.5 R

[58] Field of Search ..... 242/18 PW, 18 A, 18 DD, 242/25 A, 35.5 R

[56] References Cited

U.S. PATENT DOCUMENTS

| | | | |
|---|---|---|---|
| 2,998,202 | 8/1961 | Keith et al. | 242/18 PW |
| 3,276,704 | 10/1966 | Pabis | 242/18 PW |
| 3,782,648 | 1/1974 | Ito et al. | 242/35.5 R |
| 3,792,819 | 2/1974 | Schippers | 242/18 PW X |
| 3,814,339 | 6/1974 | Hudson | 242/18 PW |
| 3,814,341 | 6/1974 | Dickson et al. | 242/18 PW X |
| 3,908,917 | 9/1975 | Tschentscher | 242/18 PW |
| 3,960,336 | 6/1976 | Tschentscher | 242/18 PW |
| 3,964,721 | 6/1976 | Owens et al. | 242/18 PW |
| 3,982,707 | 9/1976 | Saleeby | 242/18 PW |
| 4,023,741 | 5/1977 | Schar | 242/18 PW |

*Primary Examiner*—Stanley N. Gilreath
*Attorney, Agent, or Firm*—Neil F. Markva

[57] ABSTRACT

The method and assembly of the invention is used to insert threads, yarns and the like into a winding device having an open-ended slot and a plurality of traversing devices disposed along the slot. Each traversing device includes a reverse thread roller mounted in a casing. The winding device includes means for supporting a spool adjacent each traversing device and each spool has a catch slot therein for starting the winding of the thread package. The method comprises the steps of guiding a plurality of threads equal to the number of spools being wound to one end and in front of the winding device. The threads are guided in common as a bundle, yet are separate from one another. The threads are then moved from one end of the winding device into a spacing apart with respect to each other corresponding to the line of the spools through the insertion slot of the winding device. Then, the spaced apart threads are simultaneously inserted into the catch slots of the spools. The assembly includes the various mechanisms to accomplish the specific method steps.

24 Claims, 7 Drawing Figures

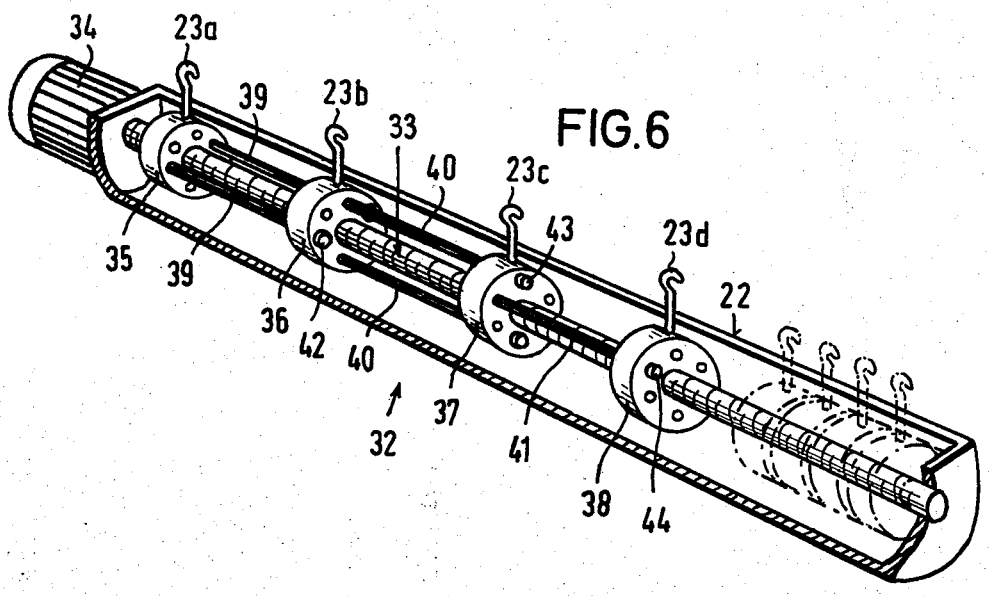
FIG.6
FIG.7
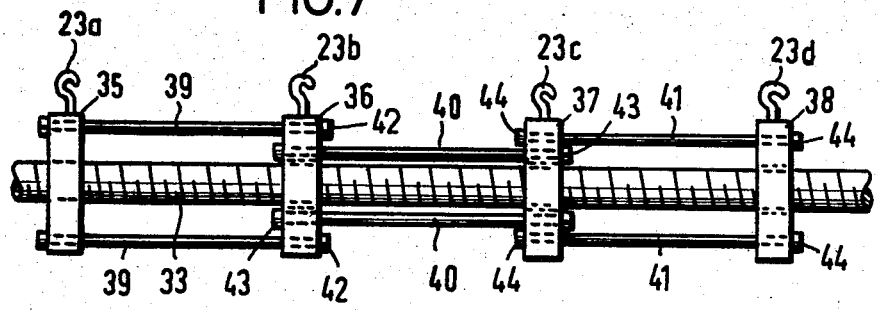

METHOD AND DEVICE FOR INSERTING THREADS, YARNS AND THE LIKE INTO A WINDING DEVICE

BACKGROUND OF THE INVENTION

This invention relates to a method of and a device for inserting threads or yarns into a winding device. The thread is fed by a traversing device having a reverse-thread roller mounted in a casing, and the start of the thread is brought through a slot, open at one end, in the winding device, to an entrainment device in a spool, e.g. to a catch slot located in said spool at least two traversing devices and spools are located next to each other in axial sequence.

In order to wind a thread or yarn on to a spool, winding machines are so formed that the thread is fed to the spool from a delivery mechanism or the like by means of a traversing device, i.e. of a reciprocating thread guide. Thus, when winding begins, the start of the thread is passed along through an insertion slot, open at one end, in the winding machine. The spool may be driven by a spindle or by a friction roller, the latter bearing on the circumference of the spool or of the package wound thereon. Winding machines are frequently constructed with two or more spools located axially next to one another on a mandrel usually an expansible mandrel, to form two or more independent thread windings. Difficulties arise in rapidly and reliably handling the threads coming from the delivery mechanism or the like, so that said threads can be brought to the adjacent spools without mutual interference. As the threads are fed continuously and at high speed, they cannot be manually handled. A device is used in which the thread is seized and guided by a suction airflow, said device being termed a suction gun. Despite said device, it is difficult to bring the threads to the correct point. This cannot be effected simultaneously with all the threads; and they are brought rather in succession and individually to the traversing devices and spools. This has the drawback that the threads begin to wind on to the spools at different times. This means that windings of different lengths result on the spools, as the entire winding machine is switched off at the end of a winding operation. Moreover, a certain amount of time is lost in inserting the threads, as they must be dealt with in succession. In the case of a winding device with four or more spools, the time-loss for inserting the threads in the winding device is considerable, particularly when there is a large number of winding devices in the machine. This impairs the efficiency of the winding machine.

An object of the invention is, in a winding device having at least two axially-adjacent spools and traversing devices, to simplify the insertion of threads to the spools, and to enable all threads to be simultaneously mechanically inserted.

SUMMARY OF THE INVENTION

According to the present invention there is provided a method of inserting threads, yarns and the like into a winding device. The thread is fed to a spool by means of a traversing device having a reverse-thread roller mounted in a casing. The start of the thread is brought by an open-ended slot in the winding device to an entrainment device of the spool e.g. to a catch slot in the spool. At least two traversing devices with associated spools are located next to one another. The threads are guided at one end in front of the winding device is common as a bundle, yet separately from one another. Thereafter, the threads are brought with simultaneous movement through the insertion slot of the winding device and passed into a spacing apart corresponding to the line of the spools, and are then simultaneously inserted into the catch slots of the spools. The spaced-apart threads are preferably moved out across the location of the catch slots of the spools, axially thereto, whereupon the threads are passed in common back to the catch slot locations, and are inserted together into the catch slots. This increases and renders more reliable the precision of the threads' movement.

The device for simultaneously inserting several threads into the winding device may be so designed that there are provided, in front of the insertion slot of the winding device, a thread guide rod with guide grooves for the threads, and in front of the support shaft for the spools, a swingable beam. The beam has thread eyelets or hooks movably disposed along the length of said beam.

There may be associated with the thread guide rod an ejector for lifting the threads out of their guide grooves. The thread guide rod is preferably located on the casing of the reciprocating devices. The casing may be mounted so as to be rotatable through an angle permitting the thread guides of the traversing devices, when in the turned position, to lie outside the tangent vertical to the casing.

This arrangement of the thread guide rod, the ejector and the beam simply and reliably enables the threads seized by the suction gun to be mechanically separated so that the threads can be simultaneously threaded into the spools, i.e. into the catch slots thereof. The threads, still running relatively close together on the thread guide rod, are moved axially to the winding device after being threaded into the eyelets on the beam, on the one hand along the feed slot of the winding device, and on the other hand in front of the axially-adjacent spools. As soon as the threads have adopted their spaced-apart positions in front of the catch slots in the spools, lowering of the beam brings the threads close to the catch slots and inserts them therein. Winding of the threads on to the spools then begins automatically, and causes automatic pull-off of the threads from the suction gun. The other components on the winding device firstly pass the threads on to the spool in a reserve winding. Thereafter, the threads are taken up by the thread guides of the traversing device, whereupon the actual winding of the thread on to a spool is carried out. Meantime, the eyelets on the beam, and the ejector, revert to their original positions.

In order to effect movement of the eyelets along the beam, the latter may be fitted with a rotatable threaded spindle which engages in a nut carrying one of the eyelets guided in a slot in the beam. Movable discs, each carrying an eyelet, may be mounted on the threaded spindle, said discs being connected and to the nut by entrainment rods. Thus, when the nut with the first eyelet moves upon rotation of the threaded spindle through a predetermined distance, the first eyelet-carrying disc is moved along the pivot beam. Thereafter, each successive disc is moved and spaced from the one preceding it, until the discs and eyelets reach the required positions in front of the spools.

The beam is preferably mounted on arms which can pivot around a shaft, from a position below the row of spools to a position in front of said row, and in the reverse direction, whereby the insertion of threads is effected in the spools or catch slots. In this case, it is advisable to make the beam transversely movable during its swinging movement by means of a slide, e.g. a wedge-piece. This ensures that all eyelets are simultaneously brought into the exact position in front of the catch slots of the spools.

BRIEF DESCRIPTION OF DRAWINGS

An embodiment of the invention will be described, by way of example, with reference to the accompanying diagrammatic drawings, in which:

FIGS. 6 and 7 show the pivot beam, in prospective and schematically, respectively, with the device for moving the eyelets or hooks along said beam.

DESCRIPTION OF SPECIFIC EMBODIMENTS

Figure 1:
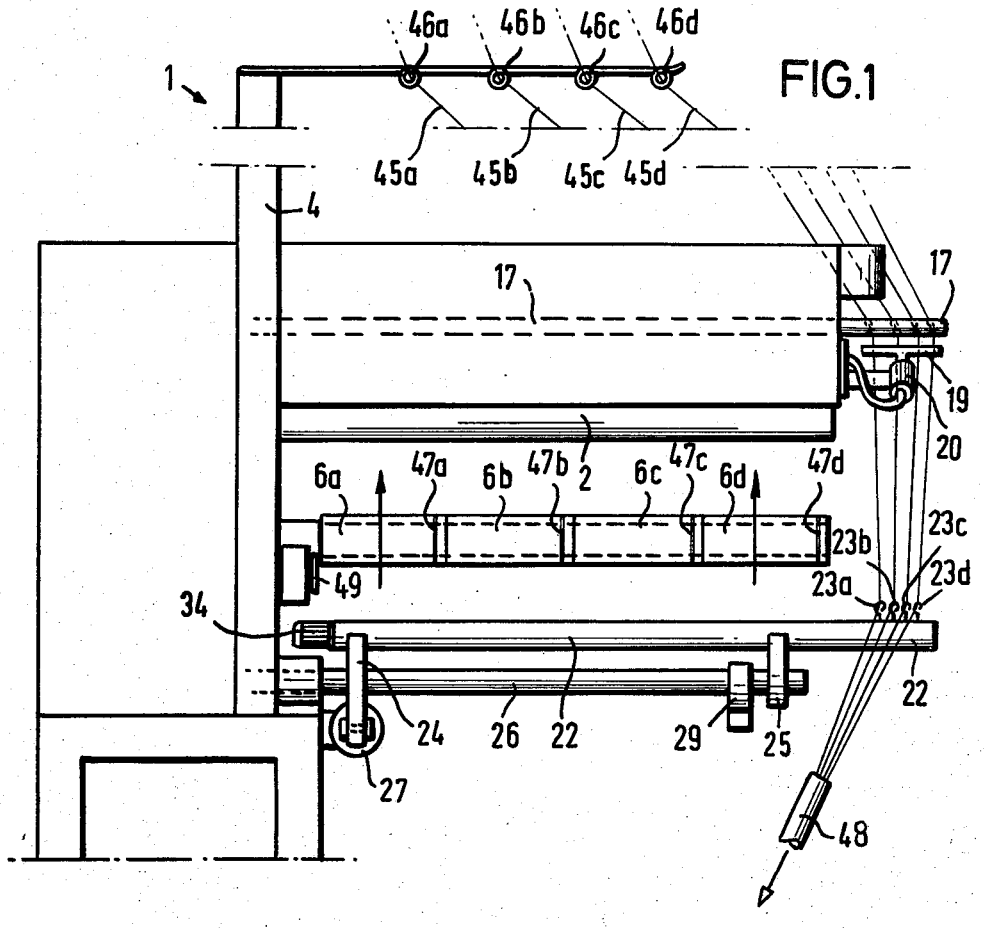
FIG. 1 is a front elevational view of a winding device according to the present invention.

Referring to the drawings, a winding device 1 has a driven friction roller 2, mounted in bearings 3 in a winding machine frame 4. Thrust on to a mandrel 5, preferably an expansible mandrel, are axially-adjacent spools, 6a, 6b, 6c, 6d, which are driven by the friction roller 2. A thread package, which enlarges during winding, bears with its circumference on the friction roller 2. The mandrel 5, located on a pivot beam, can move in a slot 7, in a wall of the winding device, in proportion to the increase in diameter of the thread package. In accordance with the number of adjacently-located spools, there are rotatably mounted in the casing 8, reverse-thread rollers 9a, 9b, 9c, 9d, a reciprocatory thread guide 10a, 10b, 10c, 10d being associated with each reverse-thread roller. The axially-adjacent reverse-thread rollers are rotated by a driven shaft 11.

In an upper cover plate 12 of the winding device, there is an insertion slot 13 for the threads, which extends throughout the length of the adjacently-located spools and is open at its front end. Level with the ends of the adjacent spool cores 6a, 6b, 6c, 6d, to each of which a thread is to be attached, there is a device 14a, 14b, 14c, 14d for forming a reserve winding. This preferably consists of a rotatable feed worm serving to guide the incoming thread in the direction of oscillating thread guides 10a, 10b, 10c, 10d. The feed worms firstly cause a reserve winding to be formed on the spools. After the thread runs off the worm, the relevant thread, in each case, passes into the path of the reciprocating thread guide 10a, 10b, 10c, 10d, so that the thread is thereafter wound into a package on the spools. The casing 8 which contains the traversing devices is rotatable through a predetermined angle around its axis, so that the thread guides 10a, 10b, 10c, 10d of the traversing devices may be rotated out of the guide slot 13. For this purpose, there is provided an actuating element 15, consisting of a piston and cylinder unit, which is pivotally connected to a lug 16 on the casing 8. Rotation of casing 8 through a predetermined angle prevents the threads moving along the slot 13 from passing prematurely to the thread guides of the reverse-thread rollers. Reserve rotation of the casing 8 then occurs, when the threads are grasped by the spools, and contact the worms to form a reserve winding.

On the front end face of the casing 8 of the traversing devices there is a thread guide rod 17, projecting laterally over the winding device and provided on its projecting portion with guide grooves 18a, 18b, 18c, 18d. Associated with the projecting portion of thread guide rod 17 there is an ejector 19, which can be actuated by a piston and cylinder unit 20, preferably pneumatically, and which serves to remove the threads from the guide grooves, so that threads can pass along the thread guide rod 17 into the insert slot 13.

Beneath the mandrel 5 carrying the spools is a device 21 for guiding the threads from the bundle at a predetermined spacing. The device 21 has a swingable beam 22, in which thread eyelets or hooks 23a, 23b, 23c, 23d are movably mounted and drivable. The beam 22 is carried by arms 24 and 25 which are pivotal on a shaft 26, and pivoting is effected by a ram 27, pivotally connected to a lug 28 on the arm 24. The free end of the shaft 26 is supported by a bracket 29. The beam 22 with the support arms 24 and 25 is movable in a predetermined path along the shaft 26. This movement is achieved by a fixed wedge 30, on shaft 26 which co-operates with a counter-wedge 31 mounted on the support arm 25.

In the beam 22, there is a device 32 for moving the eyelets 23a, 23b, 23c, 23d at a predetermined spacing apart.

The device 32 has a screw-threaded spindle 33, preferably with a trapezoidal thread, and which is driven by the flanged-on motor 34 whose drive shaft may be driven in either direction. Engaging with the thread on the spindle 33, is a nut 35 carrying the eyelet 23a. Mounted on the spindle 33 are also, loosely-movable discs 36, 37, 38, each carrying an eyelet 23b, 23c, 23d, respectively. The nut 35 and the discs 36, 37, 38 are connected by rods 39, 40 and 41, along which the discs are movable. Rods 39, 40 and 41 have on their respective outer ends stops 42, 43 and 44. Thus, when threaded spindle 33 rotates in one direction, nut 35 with eyelet 23a is moved along spindle 33. Further, discs 36, 37 and 38 are pulled behind at a predetermined spacing by the connector rods 39, 40 and 41. When spindle 33 is rotated in the opposite direction, nut 35 and discs 36, 37, 38 are pushed together at one end of the pivot beam 22, as can be seen from the dotted-line representation of the nuts and discs.

Figure 2:
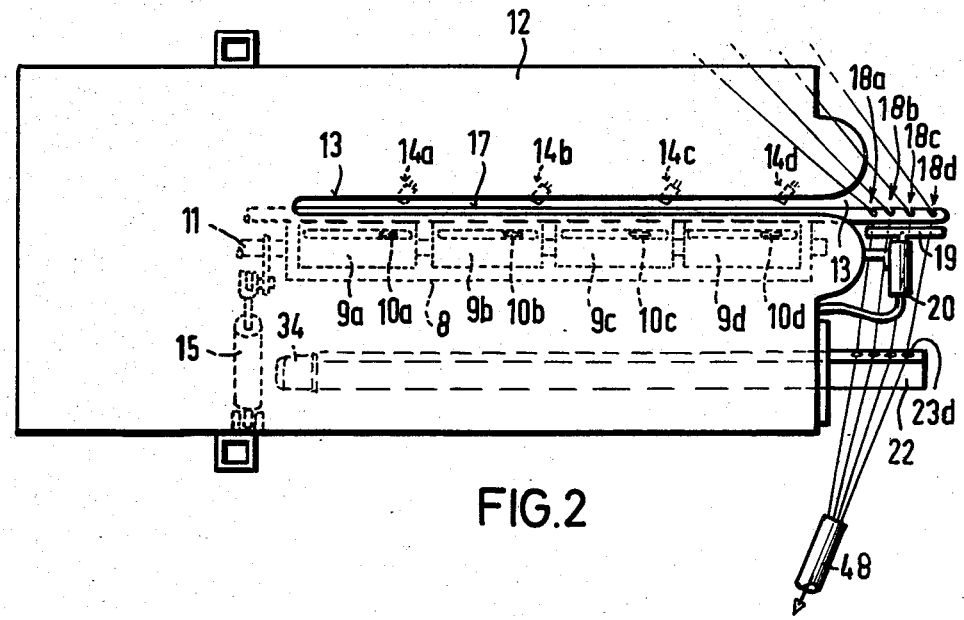
FIG. 2 is a plan view corresponding to FIG. 1.
Figure 3:
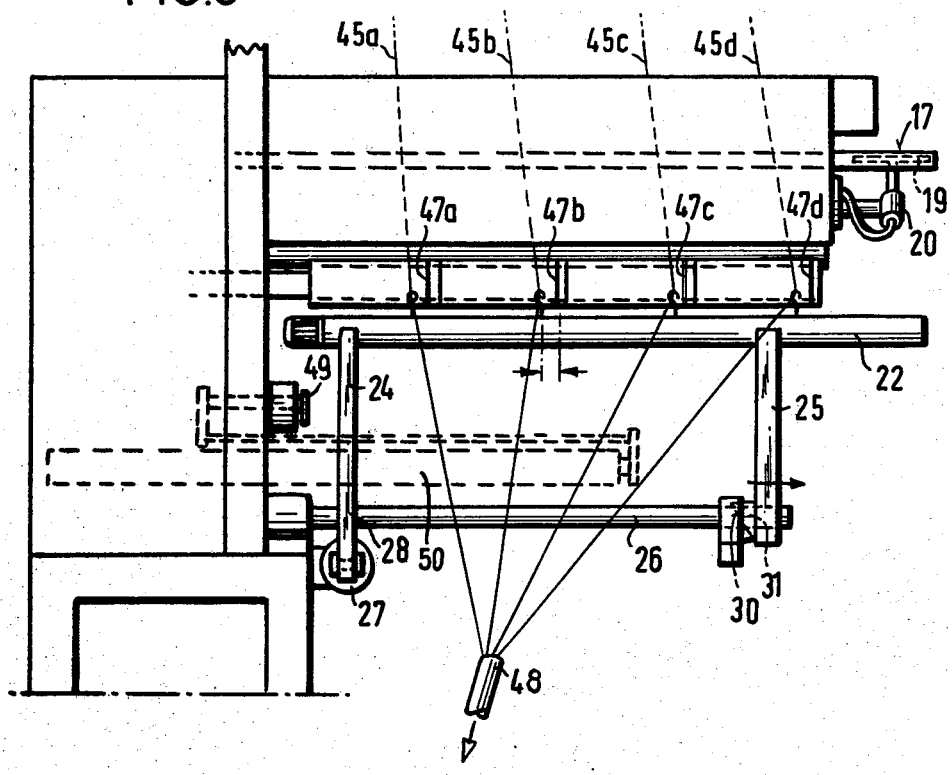
FIG. 3 is a view corresponding to FIG. 1, showing the run of the thread at a later stage of the insertion procedure.
Figure 4:
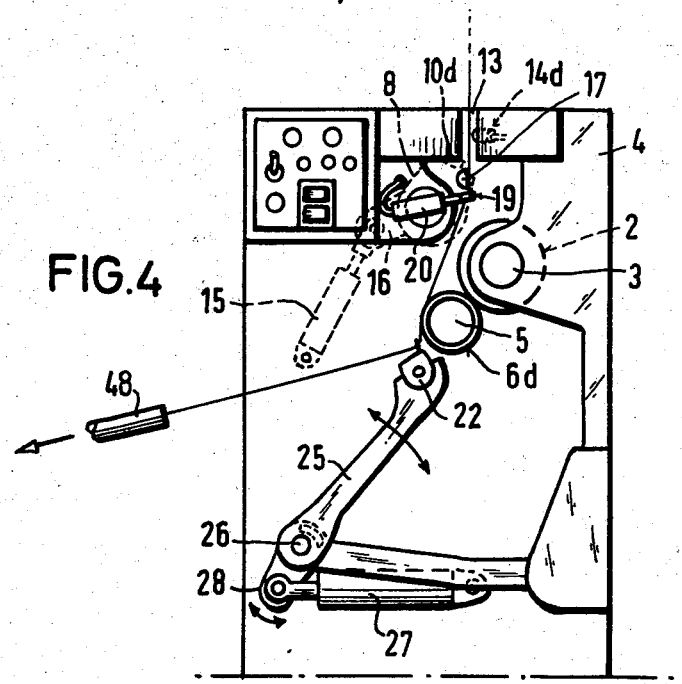
FIG. 4 is an end view of the winding device and showing the insertion slot for the incoming threads.
Figure 5:
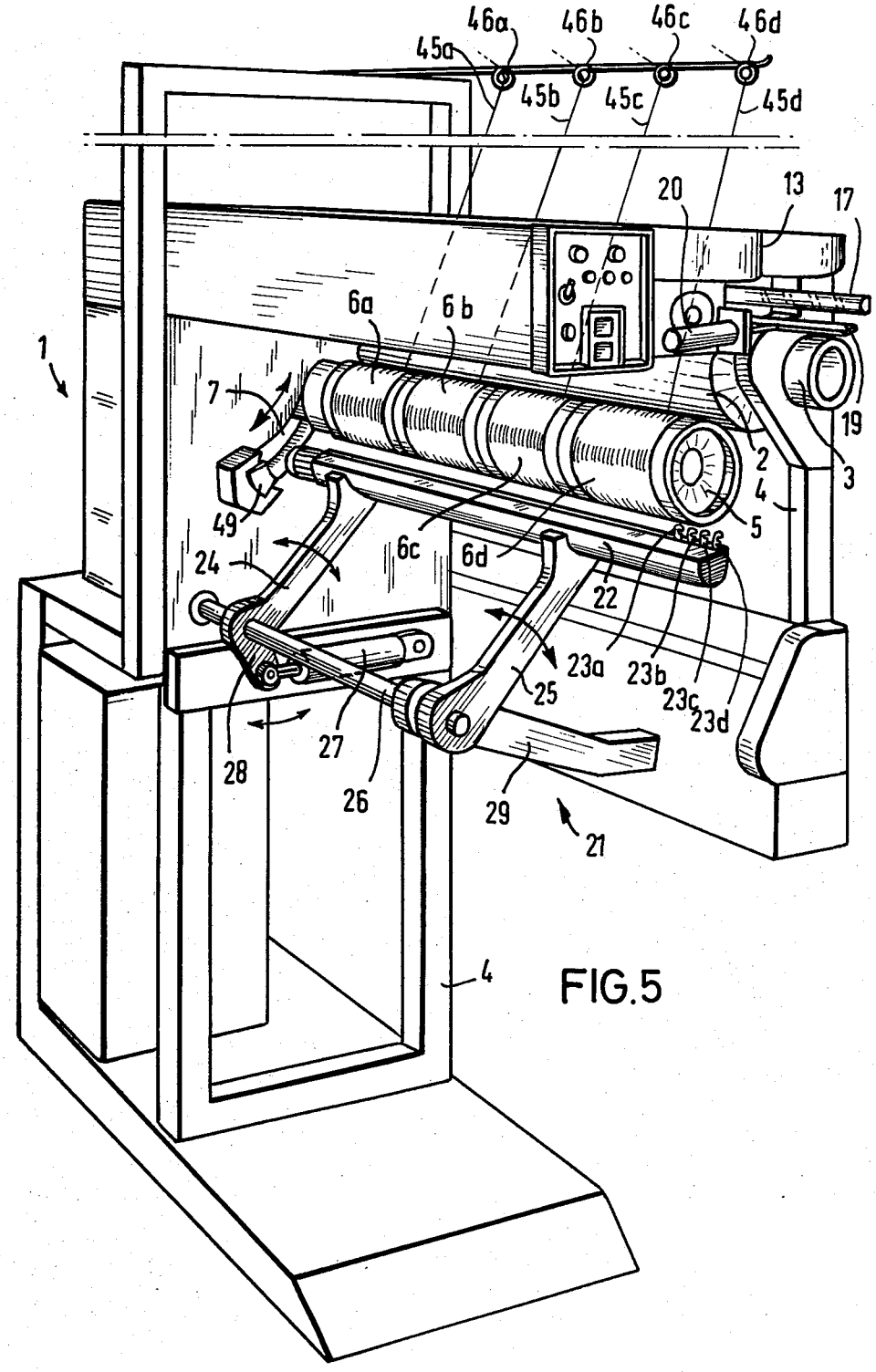
FIG. 5 is a perspective view of the winding device.

A suction gun 48 is used to pass threads 45a, 45b, 45c, 45d from a delivery mechanism (not shown) through respective guides 46a, 46b, 46c, and 46d fixed to the machine frame 4, across respective guide-grooves 18a, 18b, 18c, 18d of the thread guide rod 17, and from there into respective eyelets 23a, 23b, 23c, 23d. Previously, mandrel 5 with the spool 6a, 6b, 6c, 6d has been applied against the friction roller 2. As soon as roller 2 has achieved its predetermined r.p.m., as indicated by illumination of a monitor bulb, motor 34 of beam 22 is started. Consequently, eyelets 23a, 23b, 23c, 23d are pushed apart along beam 22 to a predetermined spacing (FIG. 3). At the same time, ejector 19 is automatically actuated, so that threads 45a, 45b, 45c, 45d are released from the guide grooves 18a, 18b, 18c, 18d of thread guide rod 17, and can move along insert slot 13. At the same time, the thread guides 10a, 10b, 10c, 10d of the reverse-thread rollers are moved out of the range of the insert slot 13 by rotation of casing 8. The eyelets 23a, 23b, 23c, 23d are pushed slightly outwards over the positions of the catch slots 47a, 47b, 47c, 47d of the cores 6a, 6b, 6c, 6d as small differences can occur in the travelpath duing entrainment of the disc. Thus, threads 45a, 45b, 45c, 45d are initially moved axially of mandrel 5 without engaging the spools. This is effected while beam 22 is in the position shown in FIGS. 1 and 2. Beam 22 and arms 24 and 25 are pivoted in a counterclockwise direction, as viewed in FIG. 4, and kept there until eyelets 23a, 23b, 23c, 23d reach their spaced apart condition, as viewed in FIG. 3. Then beam 22 is pivoted in a clockwise direction as viewed in FIG. 4. When beam 22 is lowered, threads 45a, 45b, 45c, 45d, on the one hand, come to bear on the spools 6a, 6b, 6c, 6d and, on the other hand, are pushed axially back a certain distance by the interaction of wedges 30 and 31, the threads springing into the catch slots 47a, 47b, 47c, 47d and being grasped firmly by the spools. Thus, the threads are pulled off the suction gun 48. Because of the position of the guides 46a, 46b, 46c, and 46d, the threads pass automatically into the guide slot 13 and to the feed worms 14a, 14b, 14c, 14d, the reverse winding being formed thereby on each spool. Meantime, the casing 8 with the reverse-thread roller and the thread guides 10a, 10b, 10c, 10d is brought into the range of the guide slot, so that the threads are taken up by thread guides 10a, 10b, 10c, 10d and wound onto the thread packages. After completion of the packages, these can be mechanically pushed off the mandrel 5 by the ejector device 49, 50.

The winding device may have an optional number of adjacently-mounted spools.

ADVANTAGES OF THE INVENTION

This invention enables the threads to be simultaneously seized and handled from the delivery mechanism by the suction gun, until they are held by the spools. Because the threads are spaced, each thread passes to its associated spool at the correct point for engagement by the spool's catch slot. Thread insertion time, corresponding to the number of spools, is considerably reduced. Further, the windings are formed on all spools simultaneously. Thus, the spools all contain the same length of thread and are therefore of the same weight. Above all, time is saved in inserting all the threads into the winding device, which is an important factor when there is a plurality of winding devices in line. The performance of the winding machine is increased.

While the method and device for inserting threads yarns and the like into a winding machine has been shown and described in detail, it is obvious that this invention is not to be considered as being limited to the exact form disclosed, and that changes in detail and construction may be made therein within the scope of the invention, without departing from the spirit thereof.

I claim:

1. A method of inserting threads, yarns, and the like, into a winding device having an open-ended slot and a plurality of traversing devices disposed along said slot, each traversing device including a reverse thread roller mounted in a casing, said winding device including means for supporting a spool adjacent each traversing device, each spool having a catch slot, said method comprising the steps of:

a. guiding a plurality of threads equal to the number of spools being wound to one end and in the front of the winding device, b. said threads being guided in common as a bundle, yet separately from one another, c. moving the threads from said one end into a spaced apart relationship with respect to each other corresponding to the line of said spools through the insertion slot of the winding device, and then d. simultaneously inserting the spaced apart threads into the catch slots of the spools.

2. The method as defined in claim 1 wherein the spaced apart threads are moved slightly outwardly beyond the positions of the catch slots of the spools in the actual direction of the spools, and said threads being moved thereafter in common back to the position of the catch slots before being inserted in common therein.

3. An assembly for inserting threads, yarns, and the like, into a winding device having an open-ended insertion slot and a plurality of traversing devices disposed along said slot, each traversing device including a reverse thread roller mounted in a casing, said winding device including means for supporting a spool adjacent each traversing device, each spool having a catch slot, said assembly comprising:

a. means for guiding a plurality of threads equal to the number of spools being wound to one end and in front of the winding device, b. said guiding means being effective to guide the threads in common as a bundle, yet separately from one another, c. means for moving the threads from said one end into a spaced apart relationship to each other corresponding to the line of said spools through the insertion slot of the winding slot, and d. means for simultaneously inserting the spaced apart threads into the catch slots of the spools.

4. An assembly as defined in claim 3 wherein said guiding means includes a thread guide rod having guide grooves for the threads disposed in front of the insertion slot.

5. An assembly as defined in claim 4 wherein the thread ejector means is disposed adjacent the guide rod for moving the threads out of the guide rods.

6. An assembly as defined in claim 5 wherein said ejector means is effective simultaneously with the means for moving the threads from said one end of the winding device through said insertion slot.

7. An assembly as defined in claim 6 wherein said ejector means includes pneumatic ram means effecting said moving operation.

8. An assembly as defined in claim 3 wherein said inserting means includes a movable beam means disposed in front of the spools, said beam means including individual thread holding means for directing movement of each thread along said beam means.

9. An assembly as defined in claim 8 wherein said individual thread holding means comprises eyelets or hooks.

10. An assembly as defined in claim 8 wherein said guiding means includes a thread guide rod having guide grooves for the threads disposed in front of the insertion slot.

11. An assembly as defined in claim 10 wherein the thread ejector means is disposed adjacent the guide rod for moving the threads out of the guide rods.

12. An assembly as defined in claim 11 wherein said ejector means is effective simultaneously with the means for moving the threads from said one end of the winding device through said insertion slot.

13. An assembly as defined in claim 8 wherein said beam means includes pneumatic ram means for effecting swinging movement away from the row of spools while said threads are moved from said one end of the winding device through said insertion slot.

14. An assembly as defined in claim 4 wherein the traversing devices are disposed in a casing that is rotatable through such an angle that the thread guides on the traversing devices lie outside the range of the insertion slot, and the thread guide rod is located in said casing.

15. An assembly as defined in claim 3 wherein said inserting means includes a beam means having a rotatable threaded spindle and individual thread holding means mounted on the thread spindle, said beam means includes means for rotating said threaded spindle, and said thread holding means are effective to move axially along said spindle while said spindle is rotating.

16. An assembly as defined in claim 15 wherein said thread holding means includes a nut member in driven engagement with the spindle and carrying an eyelet or hook guided in a slot in the beam member, said thread holding means including a disc member for each thread more than the one thread being held by the nut member, said disc member being slidingly movable along the spindle and carrying an eyelet or hook and being interconnected together and connected to the nut member to be carried along by the nut member which is moved axially by the rotating spindle.

17. An assembly as defined in claim 16 wherein said nut member and disc member are interconnected together by entrainment rods.

18. An assembly as defined in claim 3 wherein said inserting means includes a swingable beam means disposed in front of the spools, said beam means including a beam member mounted on support arms which are pivotally mounted on a shaft and further includes means for effecting swinging movement to the beam member, said beam means including individual thread holding means for directing movement of each thread along said beam member.

19. An assembly as defined in claim 18 wherein said beam member is swingable from beneath the row of spools into a position in front of said row.

20. An assembly as defined in claim 18 wherein said beam member is mounted for transverse axial movement, and said beam means includes coacting wedge pieces for effecting said transverse movement of the beam member during its swinging movement.

21. An assembly as defined in claim 18 wherein said guiding means includes a thread guide rod having guide grooves for the threads disposed in front of the insertion slot.

22. An assembly as defined in claim 21 wherein the thread ejector means is disposed adjacent the guide rod for moving the threads out of the guide rods.

23. An assembly as defined in claim 22 wherein said ejector means is effective simultaneously with the means for moving the threads from said one end of the winding device through said insertion slot.

24. An assembly as defined in claim 10 wherein the traversing devices are disposed in a casing that is rotatable through such an angle that the thread guides on the traversing devices lie outside the range of the insertion slot, and the thread guide rod is located in said casing.

* * * * *